US006648808B2

(12) United States Patent
Totani

(10) Patent No.: US 6,648,808 B2
(45) Date of Patent: Nov. 18, 2003

(54) PLASTIC BIG MAKING APPARATUS

(75) Inventor: Mikio Totani, Muko (JP)

(73) Assignee: Totani Corporation, Kyoto (JP)

( * ) Notice: Subject to any disclaimer, the term of this patent is extended or adjusted under 35 U.S.C. 154(b) by 93 days.

(21) Appl. No.: 09/879,111

(22) Filed: Jun. 13, 2001

(65) Prior Publication Data

US 2001/0053737 A1 Dec. 20, 2001

(30) Foreign Application Priority Data

Jun. 15, 2000 (JP) ..... 2000-179636
Aug. 28, 2000 (JP) ..... 2000-257360

(51) Int. Cl.[7] ..... B26D 7/18

(52) U.S. Cl. ..... 493/342; 493/82; 493/83; 493/281; 493/340; 493/373; 493/199

(58) Field of Search ..... 225/99, 100, 103; 493/281, 82, 83, 342, 340, 373, 199

(56) References Cited

U.S. PATENT DOCUMENTS 3,730,411 A * 5/1973 Bruckmuller ..... 225/100
4,031,816 A * 6/1977 Matsuo ..... 493/373
4,033,240 A * 7/1977 Deslauriers ..... 493/373
4,096,981 A * 6/1978 Martorano ..... 225/99
4,285,681 A * 8/1981 Walitalo et al. ..... 493/194
4,493,684 A * 1/1985 Bolton ..... 493/234
4,529,114 A * 7/1985 Casper et al. ..... 225/100
4,606,534 A * 8/1986 Gombault ..... 270/52.11
4,785,696 A * 11/1988 Martiny ..... 83/152
5,219,108 A * 6/1993 Mineki ..... 225/99
5,267,848 A * 12/1993 Totsuka ..... 425/297
6,206,262 B1 * 3/2001 Achelpohl et al. ..... 225/100
6,467,382 B1 * 10/2002 Willits et al. ..... 83/27

* cited by examiner

*Primary Examiner*—Rinaldi I. Rada
*Assistant Examiner*—Brian D Nash
(74) *Attorney, Agent, or Firm*—Armstrong, Westerman & Hattori, LLP.

(57) ABSTRACT

In an apparatus for making plastic bags from a web material comprising two or more layers of plastic film, the material is intermittently fed for a length along a longitudinal feeding path, to successively make plastic bags with wastes, each of the wastes having upstream and downstream edges. The apparatus includes partially cutting means disposed at a first station predetermined along the feeding path. The material is partially cut by the partially cutting means along the upstream and downstream edges of waste whenever intermittently fed and temporarily stopped. The apparatus further includes waste removing means disposed at a second station predetermined downstream of and at a distance from the first station. The waste reaches the second station when the material is intermittently fed again after partially cut by the partially cutting means. In addition, the apparatus includes discharge means disposed at a third station predetermined downstream of and at a distance from the second station. The material reaches the third station when intermittently fed again after partially cut by the partially cutting means. The material is pulled and torn by the discharge means from the downstream edge of waste to be discharged by the discharge means as a plastic bag, the waste being pulled, torn and removed by the waste removing means from the upstream edge of waste, after the waste reaches the second station and the material reaches the third station.

16 Claims, 6 Drawing Sheets

PLASTIC BIG MAKING APPARATUS

FIELD OF THE INVENTION

The invention relates to an apparatus for making plastic bags.

PRIOR ART

There has been commercially available an apparatus for making plastic bags 2 from a web material 4 comprising two or more layers of plastic film, as shown in FIG. 11. The apparatus includes feeding means by which the material 4 is intermittently fed for a length along a longitudinal feeding path. The material 4 is heat sealed by heat seal means longitudinally and widthwise of the material 4 whenever intermittently fed and temporarily stopped so that heat sealed portions 5 can be formed longitudinally and widthwise of the material 4. In two rows production, the material 4 may be slitted by slitting means along a slit line 6. In case of shaped bags 2 each of which has opposite sides curved convexly or concavely, the apparatus is arranged to successively make plastic bags 2 with wastes 8. Each of the wastes 8 has upstream and downstream edges 10 and 12. In general, the material 4 is totally cut by suitable cutting means along the upstream and downstream edges 10 and 12 of waste 8 whenever intermittently fed and temporarily stopped. The wastes 8 are therefore brought into existence one by one or two by two by making shaped bags 2. The waste 8 may be called a waste material or scrap.

Under the circumstances, a hole is usually formed under the feeding path of material so that the wastes can be dropped down through the hole to be removed. However, the wastes 8 can neither always be dropped down nor removed even if the material 4 is totally cut. The plastic bags 2 and the wastes 8 may adhere to each other by reason of certain factor such as static electricity, to be fed as they are. The wastes 8 must therefore be removed later and manually by operator from the plastic bags 2, taking labours and times. In addition, as to the hole through which the wastes 8 are dropped down, it is required to change the size of hole when changing the size of plastic bag 2 and waste 8.

It is therefore an object of the invention to provide a new and improved apparatus for making plastic bags from a web material comprising two or more layers of plastic film, to overcome the above problems. The apparatus including feeding means by which the material is intermittently fed for a length along a longitudinal feeding path, to successively make plastic bags with wastes, each of the wastes having upstream and downstream edges.

Another object of the invention is to provide the apparatus in which the wastes can be removed automatically and reliably, without adhering to the plastic bags.

SUMMARY OF THE INVENTION

According to the invention, the apparatus comprises partially cutting means disposed at a first station predetermined along the feeding path. The material is partially cut by the partially cutting means along the upstream and downstream edges of waste whenever intermittently fed and temporarily stopped.

The apparatus further comprises waste removing means disposed at a second station predetermined downstream of and at a distance from the first station. The waste reaches the second station when the material is intermittently fed again after partially cut by the partially cutting means.

In addition, the apparatus comprises discharge means disposed at a third station predetermined downstream of and at a distance from the second station. The material reaches the third station when intermittently fed again after partially cut by the partially cutting means. The material is pulled and torn by the discharge means from the downstream edge of waste to be discharged by the discharge means as a plastic bag, the waste being pulled, torn and removed by the waste removing means from the upstream edge of waste, after the waste reaches the second station and the material reaches the third station.

In a preferred embodiment, the partially cutting means comprises Thomson blade means opposed to the material. The partially cutting means further comprises drive means by which the Thomson blade means is moved toward the material so that the material can be partially cut by the Thomson blade means along the upstream and downstream edges of waste.

The Thomson blade means has micro depressions formed and spaced from each other along the cutting edge thereof to leave micro joints formed and spaced from each other along the upstream and downstream edges of waste. The micro joints make the material partially cut. The material and the waste are kept connected with each other by the micro joints.

The material is partially cut by the partially cutting means to be pulled and torn more easily at the downstream edge than at the upstream edge of waste. The material is first pulled and torn by the discharge means from the downstream edge of waste after the waste reaches the second station and the material reaches the third station. The waste is then pulled and torn by the waste removing means from the upstream edge of waste.

The waste removing means comprises upper and lower rotating members disposed on upper and lower sides of the feeding path. The waste removing means further comprises drive means by which at least one of the upper and lower rotating members is moved toward the waste so that the waste can be sandwiched between the upper and lower rotating members. In addition, the waste removing means comprises drive means by which at least one of the upper and lower rotating members is rotated at a considerable speed so that the waste can be pulled and torn by the upper and lower rotating members.

The discharge means comprises upper and lower belts between which the material is directed and sandwiched to be pulled and torn by the upper and lower belts.

In other embodiment, the waste is held by the waste removing means after reaching the second station so that the material can be pulled and torn by the discharge means from the downstream edge of waste. The waste is then pulled and torn by the waste removing means from the upstream edge of waste.

The waste removing means may comprise drive means by which at least one of the upper and lower rotating members is moved toward the waste so that the waste can be sandwiched between and held by the upper and lower rotating members after reaching the second station.

In other embodiment, the waste removing means comprises upper and lower fingers disposed on upper and lower sides of the feeding path. The waste removing means further comprises drive means by which at least one of the upper and lower fingers is moved toward the waste so that the waste can be sandwiched between and held by the upper and lower fingers after reaching the second station. In addition, the waste removing means comprises drive means by which the upper and lower fingers are moved in a direction so that the waste can be pulled and torn by the upper and lower fingers.

In other embodiment, the discharge means comprises drive means by which the upper and lower belts are driven at a first speed. The waste removing means comprises drive means by which at least one of the upper and lower rotating members is moved toward the waste so that the waste can be sandwiched between the upper and lower rotating members at the same time as the material is sandwiched between the upper and lower belts. The waste removing means further comprises drive means by which at least one of the upper and lower rotating members is rotated at a second speed lower than the first speed so that the material is pulled and torn by the upper and lower belts, while the waste is pulled and torn by the upper and lower rotating members, by means of a difference in speed between the upper and lower belts and the upper and lower rotating members.

In other embodiment, the apparatus comprises partially cutting means combined with totally cutting means. The material is partially cut by the partially cutting means along the upstream edge and totally cut by the totally cutting means along the downstream edge of waste whenever intermittently fed and temporarily stopped.

The apparatus further comprises discharge means disposed downstream of and at a distance from the partially and totally cutting means. The material is discharged by the discharge means as a plastic bag after partially and totally cut. The waste then reaches the discharge means when the material is intermittently fed again, to be pulled, torn and removed by the discharge means from the upstream edge of waste.

The partially cutting means comprises drive means by which the Thomson blade means is moved toward the material so that the material can be partially cut by the Thomson blade means along the upstream edge of waste. The micro joints make the material partially cut. The waste is kept connected with the material by the micro joints.

The discharge means comprises upper and lower belts, the material being directed and sandwiched between the upper and lower belts to be discharged by the upper and lower belts. The waste is then directed and sandwiched between the upper and lower belts to be pulled, torn and removed by the upper and lower belts. Stop means is incorporated into the upper and lower belts so that the waste can strike against the stop means for dropping from the upper and lower belts.

DETAILED DESCRIPTION OF THE PREFERRED EMBODIMENT

Figure 1:
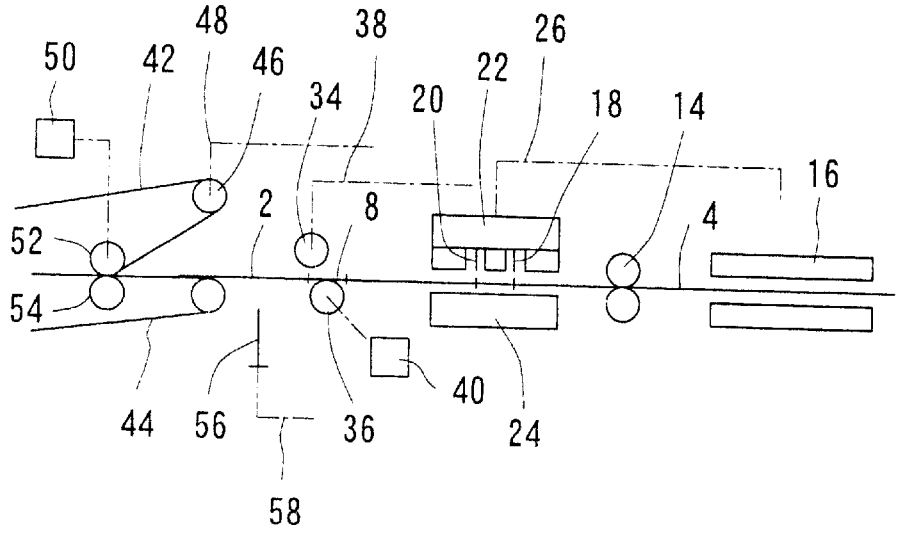
FIG. 1 is a side view of a preferred embodiment of the invention.
Figure 11:
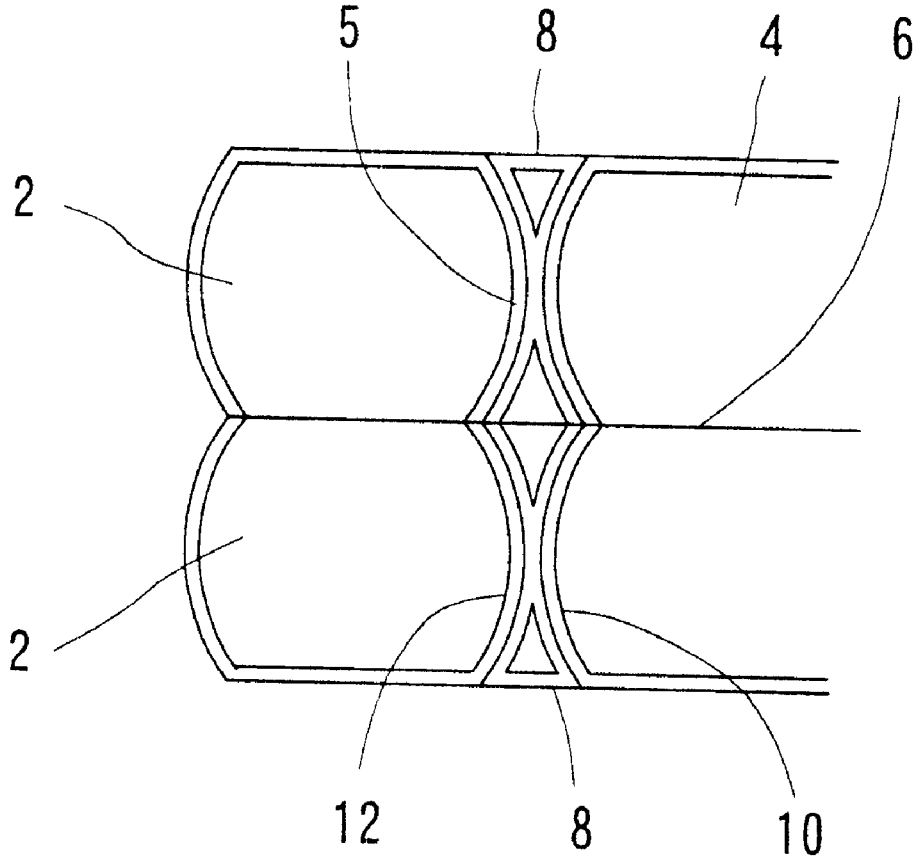
FIG. 11 Prior Art
FIG. 11 is a plan view showing plastic bags and wastes in prior art.

Referring now to the drawings, FIG. 1 illustrates an apparatus for making plastic bags 2 from a web material 4 comprising two or more layers of plastic film, according to the invention. Each of the plastic bags 2 comprises a shaped bag having opposite sides curved convexly or concavely, as in the case of the apparatus of FIG. 11. The apparatus includes feeding means by which the material 4 is intermittently fed for a length along a longitudinal feeding path, to successively make plastic bags 2 with wastes 8. Each of the wastes 8 has upstream and downstream edges 10 and 12.

In the embodiment, the feeding means comprises upper and lower rollers 14 between which the material 4 is directed and sandwiched. The upper and lower rollers 14 are rotated by drive means such as a servo motor so that the material 4 can be intermittently fed for a length. In addition, the material 4 is heat sealed by heat seal means 16 longitudinally and widthwise of the material 4 whenever intermittently fed and temporarily stopped so that heat sealed portions 5 can be formed longitudinally and widthwise of the material 4. The material 4 is slitted by slitting means along a slit line 6, as in the case of the apparatus of FIG. 11.

The apparatus further includes partially cutting means disposed at a first station predetermined along the feeding path of material 4. The material 4 is partially cut by the partially cutting means along the upstream and downstream edges 10 and 12 of waste 8 whenever intermittently fed and temporarily stopped.

The partially cutting means includes Thomson blade means comprising a pair of Thomson blades 18 and 20 and opposed to the material 4. The Thomson blades 18 and 20 are spaced from each other along the feeding path of material 4 and mounted on a carriage 22, the material 4 being directed between the Thomson blades 18 and 20 and a receiver 24. The partially cutting means further includes drive means by which the Thomson blades 18 and 20 are moved toward the material 4 whenever the material 4 is intermittently fed and temporarily stopped. For example, the drive means comprises a linkage 26 by which the carriage 22 is connected to the heat seal means 16. The Thomson blades 18 and 20 and the carriage 22 are therefore moved and lowered by the linkage 26 synchronously with the heat seal means 16 whenever the material 4 is intermittently fed and temporarily stopped so that the material 4 can be sandwiched between the Thomson blades 18 and 20 and the receiver 24 to be partially cut by the Thomson blades 18 and 20 along the upstream and downstream edges 10 and 12 of waste 8.

Figure 3:
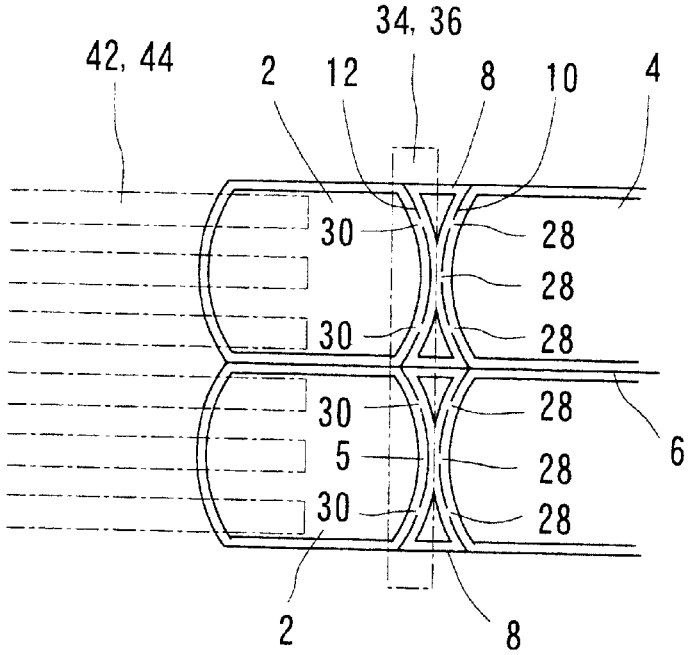
FIG. 3 is a plan view of the apparatus of FIG. 1.

In this connection, it should be noted that the material 4 is not totally cut but partially cut by the Thomson blades 18 and 20. The material 4 and the waste 8 are therefore not completely separated from each other. In the embodiment, each of the Thomson blades 18 and 20 has micro depressions formed and spaced from each other along the cutting edge thereof to leave micro joints 28 and 30 formed and spaced from each other along the upstream and downstream edges 10 and 12 of waste 8, as shown in FIG. 3. The micro joints 28 and 30 make the material 4 partially cut. The material 4 and the waste 8 are kept connected with each other by the micro joints 28 and 30. In addition, the micro joints 30 are less in number than the micro joints 28. It should therefore be understood that the material 4 is partially cut by the Thomson blades 18 and 20 to be pulled and torn more easily at the downstream edge 12 than at the upstream edge 10 of waste 8. The micro joints 28 and 30 are shown in exaggeration for convenience. In point of fact, each of the micro joints 28 and 30 has a very small size of about 0.1 mm.

Figure 2:
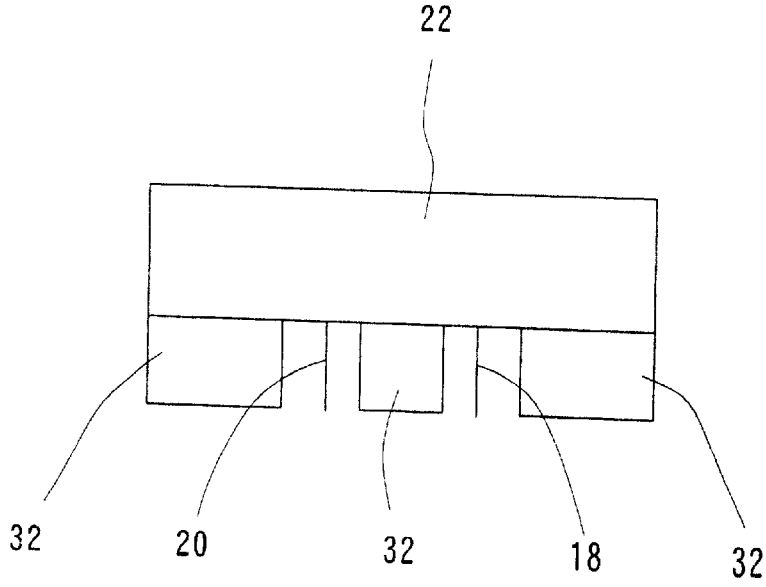
FIG. 2 is an enlarged view of the Thomson blades of FIG. 1.

Furthermore, urethan rubbers 32 are disposed on the opposite sides of each of the Thomson blades 18 and 20 and mounted on the carriage 22, as shown in FIG. 2. The urethan rubbers 32 are pressed against the material 4 and the receiver 24 to be elastically deformed so that the material 4 can be held by the urethan rubbers 32 when partially cut by the Thomson blades 18 and 20. The carriage 22 and the Thomson blades 18 and 20 are then moved and lifted by the linkage 26 synchronously with the seal means 16 to be retracted from the material 4 and the receiver 24. The urethan rubbers 32 are elastically restored to the original state so that the material 4 can be pushed by the urethan rubbers 32 to be separated from the Thomson blades 18 and 20. This prevents the material 4 from adhering to the Thomson blades 18 and 20. The material 4 is therefore not pulled upwardly by the Thomson blades 18 and 20.

The apparatus further includes waste removing means disposed at a second station predetermined downstream of and at a distance from the first station at which the Thomson blades 18 and 20 are disposed. The waste 8 reaches the second station when the material 4 is intermittently fed again after partially cut by the Thomson blades 18 and 20, as described later.

In the embodiment, the waste removing means includes upper and lower rotating means comprising upper and lower rollers 34 and 36 and disposed on upper and lower sides of the feeding path of material 4. The waste removing means further includes drive means by which at least one of the upper and lower rollers 34 and 36 is moved toward the waste 8. The drive means comprises a linkage 38 by which the upper roller 34 is connected to the heat seal means 16, as in the case of the Thomson blades 18 and 20 and the linkage 26. The upper roller 34 is therefore moved and lowered by the linkage 38 synchronously with the heat seal means 16 whenever the material 4 is intermittently fed and temporarily stopped. In addition, the waste removing means includes drive means by which at least one of the upper and lower rollers 34 and 36 is rotated at a considerable speed. The drive means comprises a drive motor 40 connected to the lower roller 36. The lower roller 36 is rotated by the drive motor 40 counterclockwise in FIG. 1 and at all times.

In addition, the apparatus includes discharge means disposed at a third station predetermined downstream of and at a distance from the second station at which the upper and lower rollers 34 and 36 are disposed. The material 4 reaches the third station when intermittently fed again after partially cut by the Thomson blades 18 and 20, as also described later. The material 4 is pulled and torn by the discharge means from the downstream edge 12 of waste 8 to be discharged by the discharge means as a plastic bag 2, the waste 8 being pulled, torn and removed by the upper and lower rollers 34 and 36 from the upstream edge 10 of waste 8, after the waste 8 reaches the second station and the material 4 reaches the third station, as also described later.

In the embodiment, the discharge means includes upper and lower belts 42 and 44 between which the material 4 is directed and sandwiched. The upper belt 42 is engaged with a pulley 46. The discharge means further includes a linkage 48 by which the pulley 46 is connected to the heat seal means 16. The pulley 46 is therefore moved and lowered by the linkage 48 synchronously with the heat seal means 16 whenever the material 4 is intermittently fed and temporarily stopped. In addition, the discharge means further includes drive means by which the upper and lower belts 42 and 44 are driven at a considerable speed. The drive means comprises a drive motor 50 connected to pulleys 52 and 54, the upper and lower belts 42 and 44 being engaged with the pulleys 52 and 54.

Furthermore, a stop 56 is disposed between the second and third station and on the lower side of the feeding path of material 4. The stop 56 is connected by a linkage 58 to the heat seal means 16 to be moved synchronously with the heat seal means 16 whenever the material 4 is intermittently fed.

In the apparatus, as to the distance between the first station at which the Thomson blades 18 and 20 are disposed and the second station at which the upper and lower rollers 34 and 36 are disposed, the distance corresponds to the length for which the material 4 is intermittently fed. As to the distance between the second station and the third station at which the upper and lower belts 42 and 44 are disposed, it also corresponds to the length for which the material 4 is intermittently fed. Accordingly, the waste 8 reaches the second position to be directed between the upper and lower rollers 34 and 36 when the material 4 is intermittently fed again after partially cut by the Thomson blades 18 and 20. The material 4 reaches the third station to be directed between the upper and lower belts 42 and 44 when intermittently fed again after partially cut by the Thomson blades 18 and 20.

Furthermore, in the apparatus, the material 4 is temporarily stopped when the waste 8 reaches the second station and the material 4 reaches the third station. The pulley 46 is then moved and lowered by the linkage 48 synchronously with the heat seal means 16 so that the material 4 can be first sandwiched between the upper and lower belts 42 and 44. The material 4 is therefore pulled by the upper and lower belts 42 and 44 driven by the drive motor 50. In addition, the material 4 was partially cut by the Thomson blades 18 and 20 to be pulled and torn more easily at the downstream edge 12 than at the upstream edge 10 of waste 8 before reaching the second and third stations, as described above. Accordingly, the material 4 is first pulled and torn by the upper and lower belts 42 and 44 from the downstream edge 12 of waste 8 after the waste 8 reaches the second station and the material 4 reaches the third station. The material 4 is therefore discharged by the upper and lower belts 42 and 44 as a plastic bag 2.

The upper roller 34 is then moved and lowered by the linkage 38 so that the waste 8 can be sandwiched between the upper and lower rollers 34 and 36. The lower roller 36 is rotated by the motor 40 counterclockwise in FIG. 1, as described above, so that the upper roller 34 can be rotated by the lower roller 36 clockwise in FIG. 1 when the waste 8 is sandwiched between them. Accordingly, the waste 8 is then pulled and torn by the upper and lower rollers 34 and 36 from the upstream edge 10 of waste 8. In addition, the stop 56 is moved by the linkage 58 into the feeding path of material 4 at the same time as the upper roller 34 is moved by the linkage 38. The waste 8 is therefore torn and removed by the upper and lower rollers 34 and 36 to strike against the stop 56 for dropping along the stop 56.

The material 4 is partially cut and intermittently fed again and again, to successively make plastic bags 2 with wastes 8. The material 4 is pulled and torn again and again to be discharged as a plastic bag 2. The waste 8 is pulled, torn and removed again and again. To be exact, in the two rows production in which the material 4 is slitted by slitting means along the slit line 6, the material 4 is pulled and torn again and again to be discharged as plastic bags 2. The wastes 8 are pulled, torn and removed again and again.

Accordingly, in the apparatus, the wastes 8 can be removed automatically and reliably. Unlike the prior art, the plastic bags 2 and the wastes 8 can not adhere to each other by reason of certain factor such as static electricity, to be fed as they are.

As to the upper and lower rollers 34 and 36, the upper roller 34 may be positioned slightly downstream of the lower roller 36 so that the waste 8 can be sandwiched between the upper and lower rollers 34 and 36 and then torn and removed downstream of and obliquely downward from the upper and lower rollers 34 and 36. In the case, the waste 8 can strike against the stop 56 which is not moved into the feeding path of material 4. The stop 56 is therefore not always required to be moved.

By the way, it should be noted that the material 4 is intermittently fed for a length which corresponds to the sum of sizes of plastic bag 2 and waste 8. As to the distance between the first station at which the Thomson blades 18 and 20 are disposed and the second station at which the upper and lower rollers 34 and 36 are disposed, it must correspond to the length for which the material 4 is intermittently fed, as described above. In this connection, the apparatus may include drive means comprising ball screws by which the upper and lower rollers 34 and 36 are moved along the feeding path of material 4 to adjust the distance between the first and second stations when changing the the size of plastic bag 2 and waste 8. The apparatus is therefore suitable to change the size of plastic bag 2 and waste 8 without difficulty. The upper and lower rollers 34 and 36 may be moved by drive means other than the ball screws.

As to the upper and lower rollers 34 and 36, instead of the lower roller 36 rotated at all the times, the upper roller 34 may be rotated at all times. Instead of the upper roller 34 moved by the linkage 38, the lower roller 34 may be moved by a linkage so that the waste 8 can be sandwiched between the upper and lower rollers 34 and 36. The upper and lower rollers 34 and 36 may be rotated at all times respectively. The upper and lower rollers 34 and 36 may be moved by linkages respectively.

One of the upper and lower rollers 34 and 36 may be rotated not at all times but temporarily. The other roller is moved by the linkage while one of the upper and lower rollers is rotated so that the waste 8 can be sandwiched between and pulled and torn by the upper and lower rollers 34 and 36.

It is not always necessary to leave the micro joints 28 and 30 formed and spaced from each other along the upstream and downstream edges 10 and 12 of waste 8. The material 4 may be half cut by the Thomson blades to a depth to be partially cut, along the upstream and downstream edges 10 and 12 of waste 8 so that the material 4 can be pulled and torn by the upper and lower belts 42 and 44 from the downstream edge 12 of waste 8, the waste 8 being pulled and torn by the upper and lower rollers 34 and 36 from the upstream edge 10 of waste 8. The material 4 may also be half cut by the Thomson blades to a depth to be partially cut so that it can be pulled and torn more easily at the downstream edge 12 than at the upstream edge 10 of waste 8. The material 4 may be partially cut by partially cutting means other than the Thomson blades.

Figure 4:
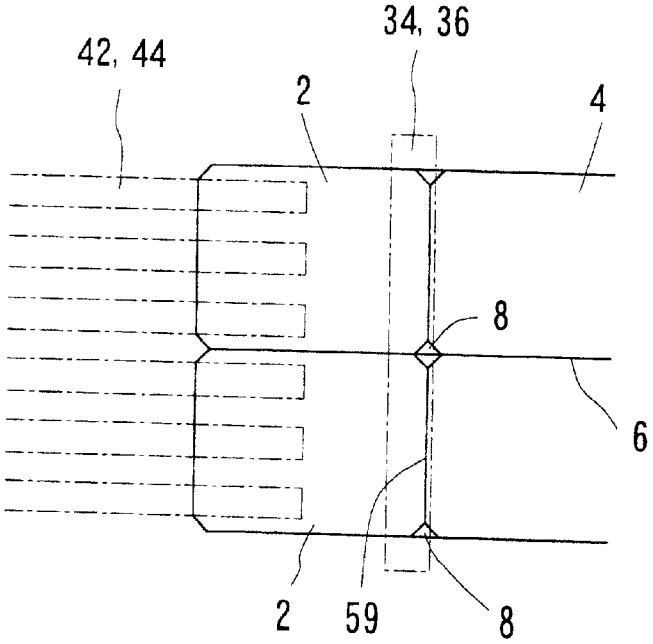
FIG. 4 is a plan view of other embodiment.

As to the plastic bag 2 to be corner cut, the apparatus is arranged to successively make plastic bags 2 with wastes 8, as shown in FIG. 4. In the case, the material 4 may be partially or totally cut by the Thomson blades along cutting lines 59. In addition, the material 4 may be partially cut by the Thomson blades along the upstream and downstream edges of the waste 8 and pulled and torn by the upper and lower belts 42 and 44 from the downstream edge of waste 8 to be discharged by the upper and lower belts 42 and 44 as a plastic bag 2. The waste 8 should be then pulled, torn and removed by the upper and lower rollers 34 and 36 from the upstream edge of waste 8.

Figure 5:
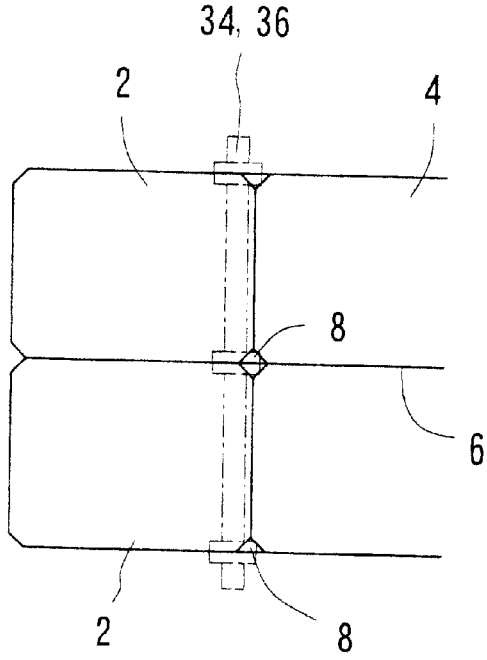
FIG. 5 is a plan view of other embodiment.

In stead of each of the upper and lower rollers 34, 36 having a diameter, it may have locally large portions so that the waste 8 can be sandwiched between and pulled, torn and removed by the locally large portions, as shown in FIG. 5.

Figure 6:
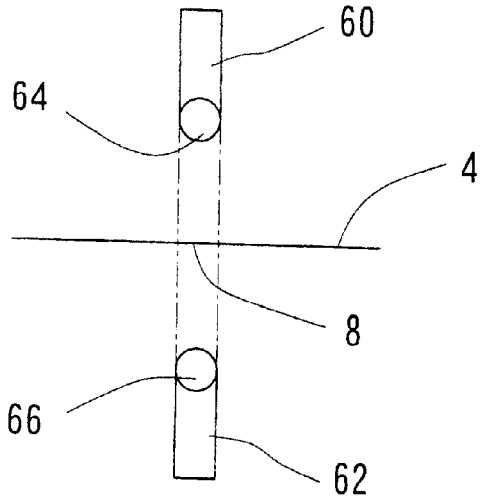
FIG. 6 is a side view of other embodiment.

The waste removing means may include rotating members other than the upper and lower rollers 34 and 36. For example, the waste removing means may include rotating members comprising upper and lower arms 60 and 62, as shown in FIG. 6. The upper arm 60 is rotated by drive means clockwise about a pin 64 while the lower arm 62 is rotated by drive means counterclockwise about a pin 66 so that the waste 8 can be sandwiched between and pulled, torn and removed downstream of the upper and lower arms 60 and 62.

Figure 7:
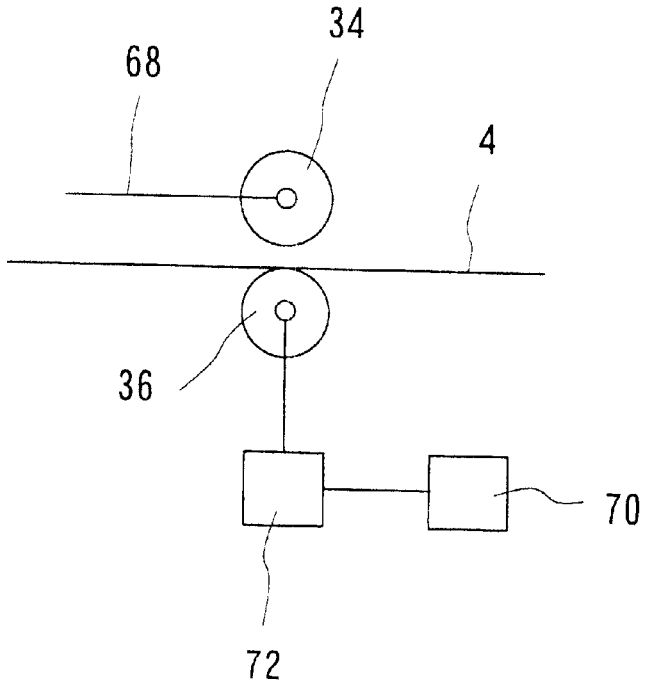
FIG. 7 is a side view of other embodiment.

In other embodiment shown in FIG. 7, the waste 8 is held by the waste removing means after reaching the second station so that the material 4 can be pulled and torn by the discharge means from the downstream edge 12 of waste 8. The waste 8 is then pulled and torn by the waste removing means from the upstream edge 10 of waste 8. The waste removing means includes upper and lower rotating member comprising upper and lower rollers 34 and 36 and disposed on the upper and lower sides of the feeding path of material 4. The discharge means comprises upper and lower belts 42 and 44, as in the case of the apparatus of FIG. 1.

In the embodiment of FIG. 7, the waste removing means further includes drive means by which at least one of the upper and lower rollers 34 and 36 is moved toward the waste 8 so that the waste 8 can be sandwiched between the upper and lower rollers 34 and 36 after reaching the second station. The drive means comprises a lever 68 and a linkage by which the upper roller 34 is connected to the heat seal means. The upper roller 34 is therefore moved by the lever 68 and the linkage so that the waste 8 can be sandwiched between the upper and lower rollers 34 and 36.

The upper and lower rollers 34 and 36 are first kept from being rotated so that the waste 8 can be held by the upper and lower rollers 34 and 36. The material 4 can therefore be pulled and torn by the upper and lower belts 42 and 44 from the downstream edge 12 of waste 8 to be discharged. Accordingly, unlike the apparatus of FIG. 1, the material 4 has therefore not to be partially cut by the partially cutting means to be pulled and torn more easily at the downstream edge 12 than at the upstream edge 10 of waste 8.

In addition, the waste removing means includes drive means by which at least one of the upper and lower rollers 34 and 36 is rotated at a considerable speed so that the waste 8 can be pulled and torn by the upper and lower rollers 34 and 36. The drive means comprises a control 70 connected to a drive motor 72 such as a servo motor which is connected to the lower roller 36. The lower roller 36 is rotated by the control 70 and the drive motor 72 counterclockwise in FIG. 7 after the material 4 is torn and discharged. The upper roller 34 is therefore rotated by the lower roller 36 clockwise in FIG. 7 so that the waste 8 can be pulled and torn by the upper and lower rollers 34 and 36 from the upstream edge 10 of waste 8 to be removed.

The drive motor 72 can be controlled by the control 70 to change the speed of the upper and lower rollers 34 and 36. For example, the upper and lower rollers 34 and 36 are rotated at a high speed when the waste 8 is pulled and torn. The upper and lower rollers 34 and 36 are then decelerated into a low speed before the waste 8 is released from the upper and lower rollers 34 and 36. The waste 8 is therefore released and removed slowly.

In the embodiment of FIG. 7, the apparatus may include ball screws by which the upper and lower rollers 34 and 36 are moved along the feeding path of material 4 to adjust the distance between the first and second stations when changing the size of plastic bag 2 and waste 8. The lower roller 36 may be moved by a linkage so that the waste 8 can be sandwiched between the upper and lower rollers 34 and 36. The drive motor 72 may be connected not to the lower roller 36 but to the upper roller 34 so that the upper and lower rollers 34 and 36 can be rotated by the drive motor 72. The upper and lower rollers 34 and 36 may be moved by linkages respectively. The drive motor 72 may be connected to the upper and lower rollers 34 and 36.

As to the plastic bag 2 and the waste 8 of FIG. 4, the waste 8 can be pulled, torn and removed by the upper and lower rollers 34 and 36 of FIG. 7. The upper and lower rollers 34 and 36 may have locally large portions, as in the case of those of FIG. 5. The waste removing means may comprise rotating members other than the upper and lower rollers 34 and 36.

Figure 8:
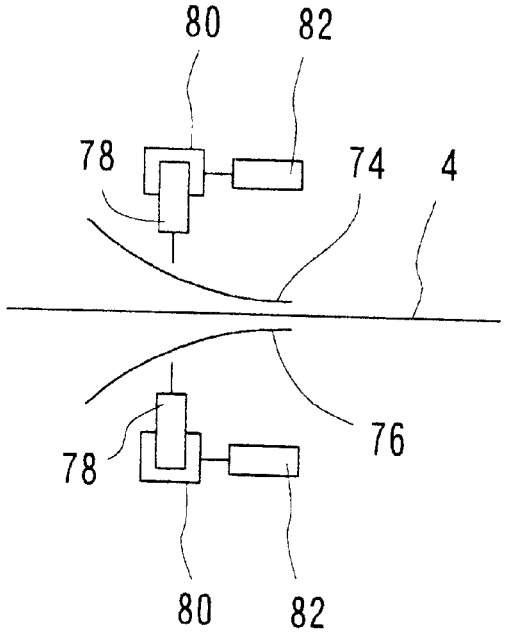
FIG. 8 is a side view of other embodiment.

In other embodiment shown in FIG. 8, the waste removing means includes upper and lower fingers 74 and 76 disposed on upper and lower sides of the feeding path of material 4. The waste removing means further includes drive means by which at least one of the upper and lower fingers 74 and 76 is moved toward the waste 8. The drive means comprises air cylinders 78 mounted on carriages 80 and connected to the upper and lower fingers 74 and 76. The upper and lower fingers 74 and 76 are moved by the air cylinders 78 so that the waste 8 can be sandwiched between and held by the upper and lower fingers 74 and 76 after reaching the second station at which the upper and lower fingers 74 and 76 are disposed.

Accordingly, the material 4 can be pulled, torn and discharged by the upper and lower belts, as in the case of the apparatus of FIG. 7. In addition, the waste removing means include drive means by which the upper and lower fingers 74 and 76 are moved in a direction in which the material 4 is intermittently fed. The drive means comprises air cylinders 82 connected to the carriages 80. The upper and lower fingers 74 and 76 and the carriages 80 are moved by the air cylinders 82 so that the waste 8 can be pulled and torn by the upper and lower fingers 74 and 76.

In the embodiment of FIG. 8, the apparatus may include ball screws by which the upper and lower fingers 74 and 76 are moved along the feeding path of material 4 to adjust the distance between the first and second stations when changing the size of plastic bag 2 and waste 8. A plurality of upper and lower fingers 74 and 76 may be spaced from each other widthwise of the material 4. The upper and lower fingers 74 and 76 may be movable widthwise of the material 4 to change the spaces of upper and lower fingers 74 and 76. In the case, as to the plastic bag 2 and the waste 8 of FIG. 4, the waste 8 can be pulled, torn and removed by the upper and lower fingers 74 and 76.

In other embodiment, the discharge means includes the upper and lower belts 42 and 44 shown in FIG. 1. The upper and lower belts 42 and 44 are driven at a first speed. The waste removing means includes upper and lower rotating members comprising the upper and lower rollers 34 and 36 in FIG. 1, FIG. 4 or FIG. 5. At least one of the upper and lower rollers 34 and 36 is moved toward the waste 8 so that the waste 8 can be sandwiched between the upper and lower rollers 34 and 36 at the same time as the material 4 is sandwiched between the upper and lower belts 42 and 44. In addition, at least one of the upper and lower rollers 34 and 36 is rotated at a second speed lower than the first speed. Accordingly, the material 4 is pulled and torn by the upper and lower belts 42 and 44, while the waste 8 is pulled and torn by the upper and lower rollers 34 and 36, by means of a difference in speed between the upper and lower belts 42 and 44 and the upper and lower rollers 34 and 36.

Figure 9:
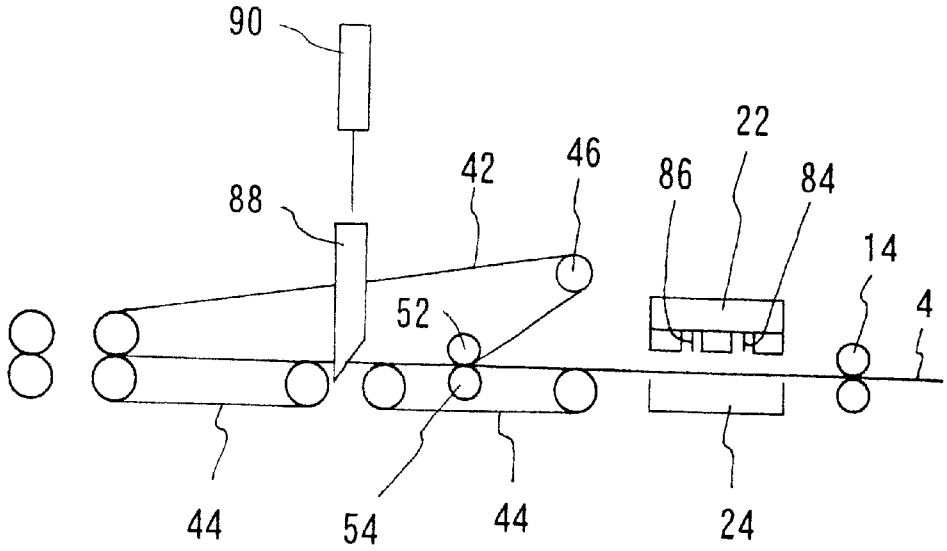
FIG. 9 is a side view of other embodiment.

In other embodiment shown in FIG. 9, the apparatus includes partially cutting means combined with totally cutting means. The material 4 is partially cut by the partially cutting means along the upstream edge 10 and totally cut by the totally cutting means along the downstream edge 12 of waste 8 whenever intermittently fed and temporarily stopped.

The partially cutting means includes Thomson blade means comprising a Thomson blade 84, mounted on a carriage 22 and opposed to the material 4. The partially cutting means further includes drive means such as the linkage 26, as in the case of the Thomson blades 18 and 20 of FIG. 1. The Thomson blade 84 has the same micro depressions as the Thomson blade 18 or 20. Accordingly, the Thomson blade 84 is moved toward the material 4 so that the material 4 can be partially cut by the Thomson blade 84 along the upstream edge 10 of waste 8. The micro joints make the material 4 partially cut. The waste 8 is therefore kept connected with the material 4 by the micro joints.

The totally cutting means comprises Thomson blade 86 mounted on the carriage 22 and opposed to the material 4. The Thomson blade 86 has no depression. Accordingly, the Thomson blade 86 is moved toward the material 4 so that the material 4 can be totally cut by the Thomson blade 86 along the downstream edge 12 of waste 8.

The apparatus further includes discharge means disposed downstream of and at a distance from the Thomson blades 84 and 86. The discharge means comprises upper and lower belts 42 and 44 between which the material 4 is directed. The upper belt 42 is engaged with the pulley 46 which is moved by the linkage 48, as in the case of the apparatus of FIG. 1, so that the material 4 can be sandwiched between the upper and lower belts 42 and 44 when partially and totally cut by the Thomson blades 84 and 86. The material 4 is therefore discharged by the upper and lower belts 42 and 44 as a plastic bag 2 after partially and totally cut by the Thomson blades 84 and 86. The pulley 46 is then moved by the linkage 48 to return to the original position.

The waste 8 then reaches the upper and lower belts 42 and 44 when the material 4 is intermittently fed again. In the embodiment, the waste 8 is directed and sandwiched between the upper and lower belts 42 and 44 at the position of pulleys 52 and 54. The waste 8 is therefore pulled, torn and removed by the upper and lower belts 42 and 44 from the upstream edge 10 of waste 8.

Figure 10:
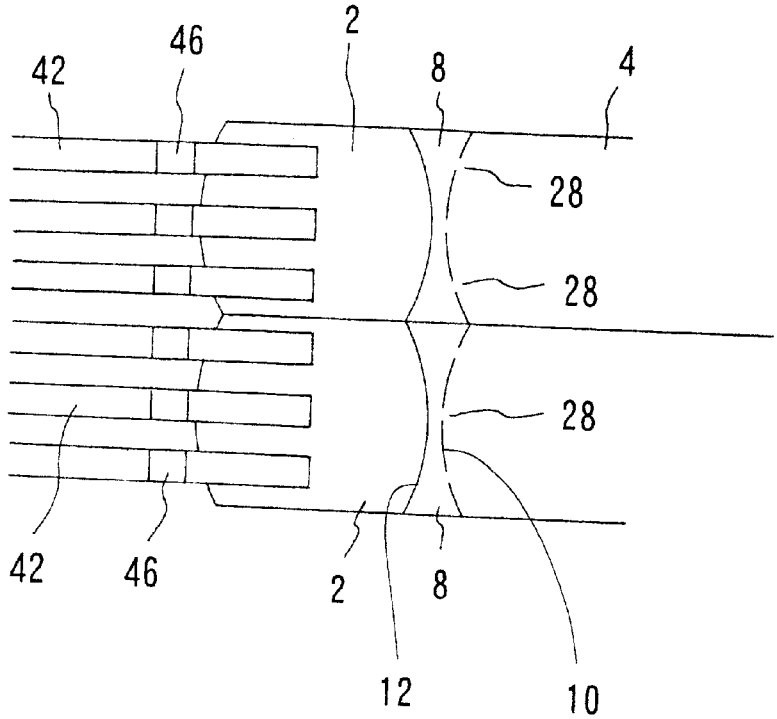
FIG. 10 is a plan view of the apparatus of FIG. 9.

The apparatus further includes stop means incorporated into the upper and lower belts 42 and 44. In the embodiment, the upper belt 42 comprises a plurality of narrow belts extending parallel to the feeding path of material 4 and spaced from each other perpendicularly to the feeding path of material 4, as shown in FIG. 10. The stop means comprises a stop 88 which is comb-shaped and inserted between the narrow belts 42. The lower belt 44 comprises upstream and downstream belts spaced from each other along the feeding path of material 4. The stop 88 is moved by an air cylinder 90 to advance into the feeding path of material 4 between the upstream and downstream belts 44 when the waste 8 is pulled and torn by the upper and lower belts 42 and 44 so that the waste 8 can strike against the stop 88 to pass between the upstream and downstream belts 44 for dropping from the upper and lower belts 42 and 44. The stop 88 is then moved by the air cylinder 90 to return the original position.

The material 4 is partially and totally cut again and again, to be discharged as a plastic bag 2. The waste 8 is then pulled, torn and removed again and again.

The apparatus may include detector means for detecting rejected bags. In the case, the stop 88 may be moved in response to the detecting signal from the detector means so that rejected bags can be removed by the stop 88.

What is claimed is:

1. An apparatus for making plastic bags from a web material comprising two or more layers of plastic film, said apparatus including feeding means by which said material is intermittently fed for a length along a longitudinal feeding path, and heat seal means by which said material is heat sealed whenever intermittently fed and temporarily stopped, to successively make plastic bags with wastes, each of said wastes having upstream and downstream edges, said apparatus comprising:

partially cutting means disposed at a first station predetermined along said feeding path, said material being partially cut by said partially cutting means along said upstream and downstream edges of waste whenever intermittently fed and temporarily stopped;

waste removing means disposed at a second station predetermined downstream of and at a distance from said first station, said waste reaching said second station when said material is intermittently fed again after partially cut by said partially cutting means; and discharge means disposed at a third station predetermined downstream of and at a distance from said second station, said material reaching said third station when intermittently fed again after partially cut by said partially cutting means, said material being pulled and torn by said discharge means from said downstream edge of waste to be discharged by said discharge means as a plastic bag, said waste being pulled, torn and removed by said waste removing means from said upstream edge of waste, after said waste reaches said second station and said material reaches said third station.

2. The apparatus as set forth in claim 1 wherein said partially cutting means comprises blade means opposed to said material, and drive means by which said blade means is moved vertically toward said material so that said material can be partially cut by said blade means along said upstream and downstream edges of waste.

3. The apparatus as set forth in claim 2 wherein said blade means has micro depressions formed and spaced from each other along the cutting edge thereof to leave micro joints formed and spaced from each other along said upstream and downstream edges of waste, said micro joints making said material partially cut, said material and said waste being kept connected with each other by said micro joints.

4. The apparatus as set forth in any one of claims 1 to 3 wherein said material is partially cut by said partially cutting means to be pulled and torn more easily at said downstream edge than at said upstream edge of waste, said material being first pulled and torn by said discharge means from said downstream edge of waste after said waste reaches said second station and the material reaches said third station, said waste being then pulled and torn by said waste removing means from said upstream edge of waste.

5. The apparatus as set forth in claim 4 wherein said waste removing means comprises upper and lower rotating members disposed on upper and lower sides of said feeding path, drive means by which at least one of said upper and lower rotating members is moved vertically toward said waste so that said waste can be sandwiched between said upper and lower rotating members, and drive means by which at least one of said upper and lower rotating members is rotated at a considerable speed so that said waste can be pulled and torn by said upper and lower rotating members.

6. The apparatus as set forth in claim 5 wherein said discharge means comprises upper and lower belts between which said material is directed and sandwiched to be pulled and torn by said upper and lower belts.

7. The apparatus as set forth in any one of claims 1 to 3 wherein said waste is held by said waste removing means after reaching said second station so that said material can be pulled and torn by said discharge means from said downstream edge of waste, said waste being then pulled and torn by said waste removing means from said upstream edge of waste.

8. The apparatus as set forth in claim 7 wherein said waste removing means comprises upper and lower rotating members disposed on upper and lower sides of said feeding path, drive means by which at least one of said upper and lower rotating members is moved vertically toward said waste so that said waste can be sandwiched between and held by said upper and lower rotating members after reaching said second station, and drive means by which at least one of said upper and lower rotating members is rotated at a considerable speed so that said waste can be pulled and torn by said upper and lower rotating members.

9. The apparatus as set forth in claim 8 wherein said discharge means comprises upper and lower belts between which said material is directed and sandwiched to be pulled and torn by said upper and lower belts.

10. The apparatus as set forth in claim 7 wherein said waste removing means comprises upper and lower fingers disposed on upper and lower sides of said feeding path, drive means by which at least one of said upper and lower fingers is moved vertically toward said waste so that said waste can he sandwiched between and held by said upper and lower fingers after reaching said second station, and drive means by which said upper and lower fingers are moved in a direction so that said waste can be pulled and torn by said upper and lower fingers.

11. The apparatus as set forth in claim 10 wherein said discharge means comprises upper and lower belts between which said material is directed and sandwiched to be pulled and torn by said upper and lower belts.

12. The apparatus as set forth in any one of claims 1 to 3 wherein said discharge means comprises upper and lower belts between which said material is directed and sandwiched, and drive means by which said upper and lower belts are driven at a first speed, said waste removing means comprising upper and lower rotating members disposed on upper and lower sides of said feeding path, drive means by which at least one of said upper and lower rotating members is moved vertically toward said waste so that said waste can be sandwiched between said upper and lower rotating members at the same time as said material is sandwiched between said upper and lower belts, and drive means by which at least one of said upper and lower rotating members is rotated at a second speed lower than said first speed so tat said material is pulled and torn by said upper and lower belts, while said waste is pulled and torn by said upper and lower rotating members, by means of a difference in speed between said upper and lower belts and said upper and lower rotating members.

13. An apparatus for making plastic bags from a web material comprising two or more layers of plastic film, said apparatus including feeding means by which said material is intermittently fed for a length along a longitudinal feeding path, to successively make plastic bags with wastes, each of said wastes having upstream and downstream edges, said apparatus comprising:

partially cutting means combined with totally cutting means, said material being partially cut by said partially cutting means along said upstream edge and totally cut by said totally cutting means along said downstream edge of waste whenever intermittently fed and temporarily stopped; and discharge means disposed downstream of and at a distance from said partially and totally cutting means, said material being discharged by said discharge means as a plastic bag after partially and totally cut, said waste then reaching said discharge means when said material is intermittently fed again, to be pulled, torn and removed by said discharge means from said upstream edge of waste.

14. The apparatus as set forth in claim 13 wherein said partially cutting means comprises blade means opposed to said material, and drive means by which said blade means is moved vertically toward said material so that said material can be partially cut by said blade means along said upstream edge of waste.

15. The apparatus as set forth in claim 14 wherein said blade means has micro depressions formed and spaced from each other along the cuffing edge thereof to leave micro joints formed and spaced from each other along said upstream edge of waste, said micro joints making said material partially cut, said waste being kept connected with said material by said micro joints.

16. The apparatus as set forth in any one of claims 13 to 15 wherein said discharge means comprises upper and lower belts, said material being directed and sandwiched between said upper and lower belts to be discharged by said upper and lower belts, said waste being then directed and sandwiched between said upper and lower belts to be pulled, torn and removed by said upper and lower belts, stop means being incorporated into said upper and lower belts so that said waste can strike against said stop means for dropping from said upper and lower belts.

* * * * *